US011253735B1

(12) United States Patent
Stevens, Sr.

(10) Patent No.: US 11,253,735 B1
(45) Date of Patent: Feb. 22, 2022

(54) SYSTEM AND METHOD FOR SAFE SIPPER MASK

(71) Applicant: Danell L. Stevens, Sr., Suisun City, CA (US)

(72) Inventor: Danell L. Stevens, Sr., Suisun City, CA (US)

( * ) Notice: Subject to any disclaimer, the term of this patent is extended or adjusted under 35 U.S.C. 154(b) by 0 days.

(21) Appl. No.: 17/367,499

(22) Filed: Jul. 5, 2021

(51) Int. Cl.
*A62B 18/08* (2006.01)
*A62B 18/02* (2006.01)

(52) U.S. Cl.
CPC ..... *A62B 18/086* (2013.01); *A62B 18/025* (2013.01)

(58) Field of Classification Search
CPC ..... A62B 18/02; A62B 18/025; A62B 18/086; A62B 23/02; A62B 23/025; A61M 16/06–0694; A61M 2016/0661; A41D 13/11–1192
See application file for complete search history.

(56) References Cited

U.S. PATENT DOCUMENTS 3,189,171 A * 6/1965 Miller ..... A47G 21/189 206/229
4,856,509 A * 8/1989 Lemelson ..... A41D 13/1146 128/206.19
7,958,889 B1 * 6/2011 Fernandez-DeCastro ..... A62B 18/086 128/202.15
10,905,905 B1 2/2021 Dettore
10,980,296 B1 * 4/2021 Hosac ..... A62B 18/10
2003/0024533 A1 * 2/2003 Sniadach ..... A61M 16/06 128/205.25
2009/0084385 A1 * 4/2009 Lang ..... A62B 18/086 128/206.21
2014/0018691 A1 * 1/2014 McNeill ..... A61M 16/085 600/532

FOREIGN PATENT DOCUMENTS

DE 202020102748 U1 7/2020
WO 2020168947 A1 8/2020

OTHER PUBLICATIONS

Reusable Face Mask With Straw Hole for Drinking, https://www.amazon.com/Reusable-Face-Mask-Straw-Drinking/dp/B08FTLLT61 [Date accessed: Apr. 30, 2021].

* cited by examiner

*Primary Examiner* — Valerie L Woodward
(74) *Attorney, Agent, or Firm* — Christopher Mayle; Bold IP, PLLC

(57) ABSTRACT

A system and method for safe sipper mask with a slidable element to open and close an opening on the mask as well as straw placed in the opening with a protrusion to stop the straw from entering too far into the mouth of the wearer whereby the mask has a stabilizer positioned between the inner and outer surfaces to provide stiffness.

12 Claims, 5 Drawing Sheets

SYSTEM AND METHOD FOR SAFE SIPPER MASK

FIELD OF DISCLOSURE

The overall invention relates to a protective face cover, and more particularly a face cover with an attachment that can be opened and closed to provide the insertion of devices for introducing liquid through an aperture of the protective face cover without removing it.

BACKGROUND

Masks are a simple barrier to help prevent respiratory droplets from reaching others. Studies show that masks reduce the spray of droplets when worn over the nose and mouth. Masks were introduced into the operating room in the late 1800s. They quickly became popular among a public eager to protect itself against the influenza pandemic of 1918. A century later, the advent of modern molecular techniques confirmed that surgical masks can indeed provide good protection against flu. In a 2013 study, researchers counted the number of virus particles in the air around patients with flu. They found that surgical masks decreased the exhalation of large viral droplets 25-fold. However, when the wearer wishes to eat or drink, the masks must be removed so that food or drink can be consumed meaning the face is no longer protected and leading to the mask to be misplaced, lost or contaminated. Thus exists the need for an improved system and method for a safe sipper mask.

SUMMARY

The present invention is directed to embodiments including a face cover, the face cover having a front layer and back layer, the face cover configured to cover at least a mouth and a nose of a wearer, the face cover having an attachment with a tab and an opening whereby the opening is exposed when the tab is in a first position, whereby the tab is in a slidable arrangement with a first component positioned in front of and on the front layer of the face cover, whereby the first component has a slot for the tab to slide across, whereby the tab has one or more protrusions at each end to prevent the tab from sidling completely out of the slot on the first component, whereby the opening is positioned on a second component, the second component positioned behind the back layer, whereby the opening has a valve mechanism to liquid from escaping out of the face cover when closed, whereby the attachment has a stabilizer positioned between the front layer and the back layer to provide stiffness in the face cover, whereby the stabilizer has two longitudinal prongs extending from two lateral prongs, whereby ends of the two longitudinal prongs are positioned in one or more pockets 219 between the front layer and the back layer, whereby the attachment is made of plastic.

The present invention is also directed to embodiments including a face cover system having a face cover having a front layer and back layer; the face cover configured to cover at least a mouth and a nose of a wearer, the face cover having an attachment with a tab and an opening whereby the opening is accessible when the tab is in a first position and inaccessible in a second position; and a straw that is positionable within the opening, whereby the tab is in a slidable arrangement with a first component positioned in front of the front layer of the face cover, the straw having a bulged area sized to permit a length of the straw to pass through the opening while a remainder of the straw is prevented from passing through by the first component, whereby the first component has a slot for the tab to slide across, whereby the tab has one or more protrusions at each end to prevent the tab from sidling completely out of the slot on the first component, whereby the opening is positioned on a second component, the second component positioned behind the back layer, whereby the opening has a valve mechanism to liquid from escaping out of the face cover when closed, whereby the attachment has a stabilizer positioned between the front layer and the back layer to provide stiffness in the face cover, whereby the stabilizer has two longitudinal prongs extending from two lateral prongs, whereby the two longitudinal prongs extend upwardly and outwardly and downwardly and inwardly with respect to the second component.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
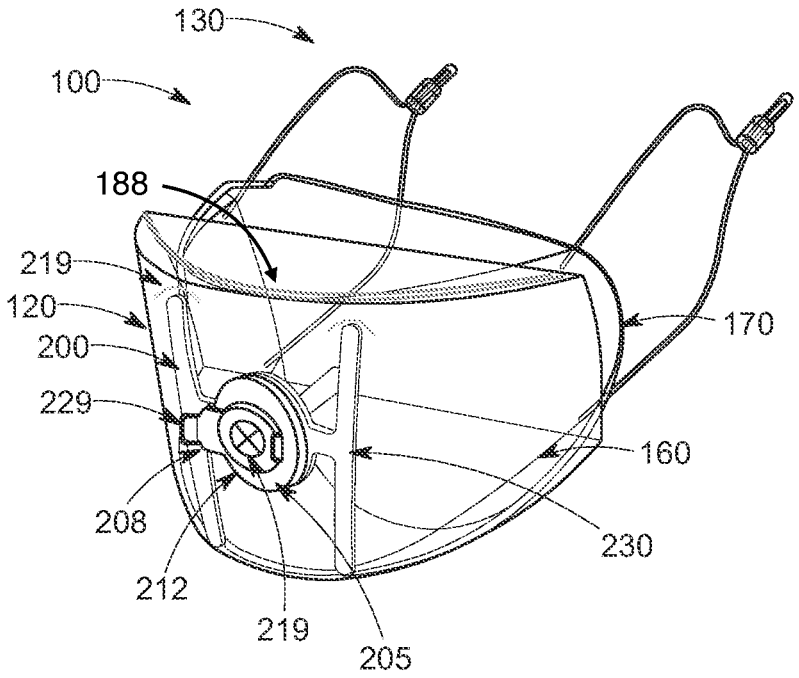
FIG. 1 is an illustration showing the safe sipper mask.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item, so a "set of items" may indicate the presence of only one item, or may indicate more items. Thus, the term "set" may be equivalent to "one or more" as used herein.

The present disclosure recognizes the unsolved need for a safe sipper mask with a slidable element to open and close an opening on the mask as well as straw placed in the opening with a protrusion to stop the straw from entering too far into the mouth of the wearer.

FIG. 1 is a perspective view of an embodiment of safe sipper mask 100 of the present invention. Safe sipper mask 100 may have a main body 120 with two ear loops 130 coupled at opposite ends of main body 120. Safe sipper mask may have one or more layers including a front layer 160 facing away from the user's face and a back layer 170 facing the user's face. Ear loops 130 act as a securing mechanism to position and attach the mask to a user's face. The user may be a human, animal, or other entity. Each ear loop 130 may have a first end coupled to a corner of main body 120 and a second end coupled to an adjacent corner of main body 120. Ear loops 130 may also be coupled to other suitable portions of main body 120. Safe sipper mask 100 may have one or more support members 188 to provide structure and firmness to the mask such that the mask does not collapse on a user's face.

In some non-limiting embodiments ear loops 130 may include one or more bands of resilient material having a greater modulus of elasticity than that of main body 120, whereby the bands at both ends may be secured proximally against the outer perimeter of main body 120 such as at the upper and lower corners. The resilient material for the bands may be selected according to their modulus of elasticity to tightly engage each of the lines of dependency such that face mask 110 may remain firmly engaged against the back of user's ears when wrapped around the users user's ears and then released. In other non-limiting embodiments ear loops 130 may be replaced by a single strap band of resilient material having a greater modulus of elasticity than that of main body 120, whereby the band may at both ends be secured proximally against the outer perimeter of main body 120 such as between the upper and lower corners or at the middle sides of main body 120.

Main Body 120 may be oval shape. However, this is non-limiting and main body 120 may be square, circular, rectangular, hexagonal, octagonal or any other shape suitable for the purpose of the present invention. In one or more embodiments main body 120 may also include a moldable nose piece connected at the top of main body 120 to provide accommodation for a user's nose.

Figure 2:
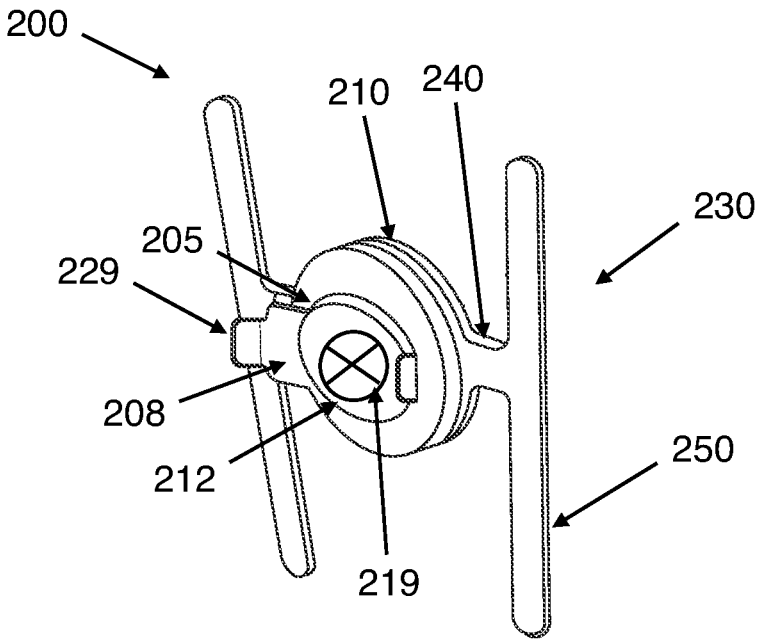
FIG. 2 is an illustration of the attachment of safe sipper mask in the opened position.

Referring to FIG. 2, main body 120 may have an attachment 200 extending between front layer 160 and back layer 170. Attachment 200 may be made of plastic or any suitable material. Attachment 200 may have a circular top component 205 with a tab 208 whereby tab 208 is in a slidable arrangement between a slot in the middle top component 205. Top component 205 may be positioned on and in front of front layer 160. Tab 208 may be discorectangle or stadium in shape with one or more apertures extending through tab 208. Tab 208 may have one or more grips or textured portions at the lateral ends to assist user in manipulating tab 208 back and forth between positions. Tab 208 may have one or more bulging ends or protrusions 229 at each end to prevent tab 208 from being dislodged from the slot in top component 205.

Attachment 200 may have a circular bottom component 210 whereby bottom component 210 extends outwardly from front layer 160 to top component 205. In some embodiments bottom component 210 may be positioned behind back layer 170 while in other embodiments bottom component 210 may be positioned between back layer 170 and front layer 160 or in front of front layer 160. Bottom component 210 has an opening 212 that can be exposed or hidden as tab 208 slides over the bottom component 210 depending on the positioning of tab 208. Opening 212 extends through front layer 160 and a back layer 170 such that opening 212 extends from a surface of main body 120 facing the wear or user and a second surface facing away from the user.

The sliding or transitional motion could be horizontal, vertical, or diagonal. Tab 208 may have a first position whereby opening 212 is accessible or exposed because one or more of the apertures in tab 208 is aligned with opening 212, as illustrated in FIG. 2. In some embodiments tab 208 may have a length and width so that it does not completely cover opening 212 when moved from side to side. Tab 208 may have a second position whereby opening 212 is covered by tab 208 and inaccessible because one or more apertures in tab 208 are not aligned with opening 212 instead having a solid part of tab 208 aligned with opening 212, as illustrated in FIG. 3.

At the bottom or lower end of opening 212, there is a one-way resilient liquid flow valve 219 with a valve base mounted inside the opening. Valve 219 allows liquid to be drawn up through a straw when a straw is positioned through valve 219. While a user is drawing liquid, valve 219 would be open, allowing the outward flow of liquid into the user's mouth. In the non-use position when the user has stopped drawing on the straw and removed the straw, valve 219 is caused by the resistance of the material of valve 219, trapping the liquid and preventing opening from being exposed when not drinking from the straw.

Figure 3:
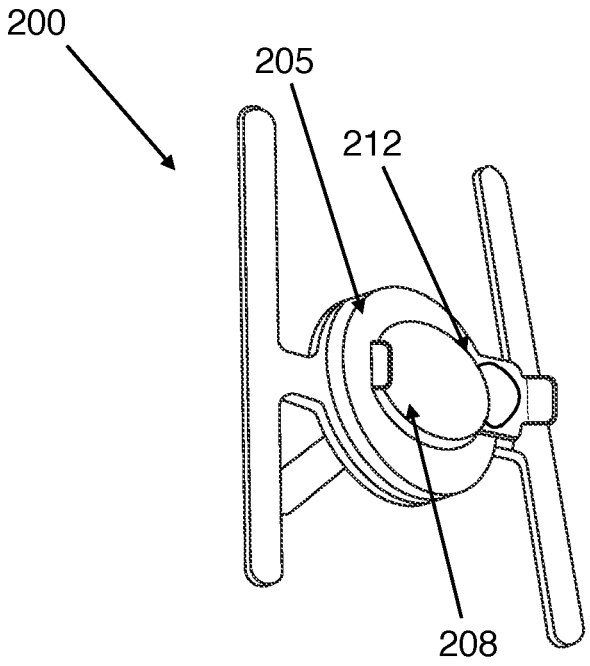
FIG. 3 is an illustration of the attachment of safe sipper mask in the closed position.

Attachment 200 may have a stabilizing portion 230 connected to bottom component 210 which is positioned between front layer 160 and back layer 170 as illustrated in FIG. 2 and FIG. 3. Stabilizing portion 230 has a circular middle portion an "H" shape having two lateral members 240 that extend outward from bottom component 210 whereby the lateral members 240 are symmetrical to one another. Stabilizing portion 230 may have a concave shape pointing inwards to the face of the user Lateral members 240 extend into two longitudinal members 250 that have upper portions that extend upward and outward from lateral members 240 and lower portions that extend downward and inward from lateral members 240. The ends of upper portions and lower portions of longitudinal members 250 may be positioned in one more pockets in the gap between back layer 170 and front layer 160.

Figure 4:
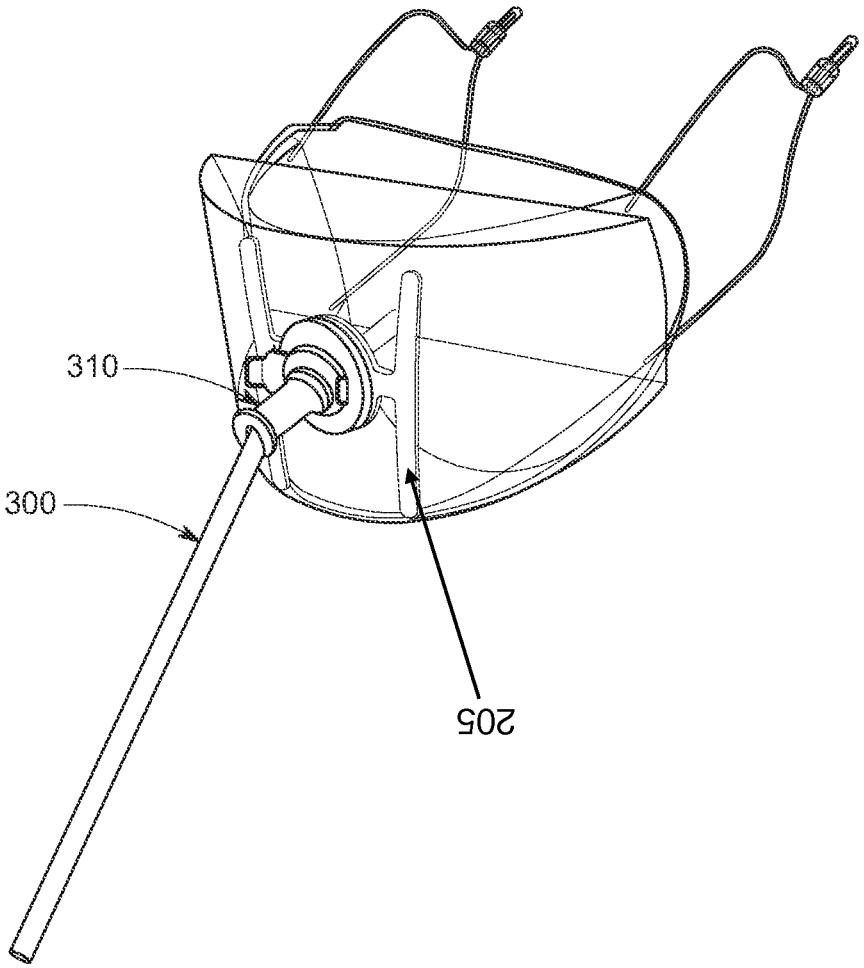
FIG. 4 is an illustration showing the straw in the attachment
Figure 5:
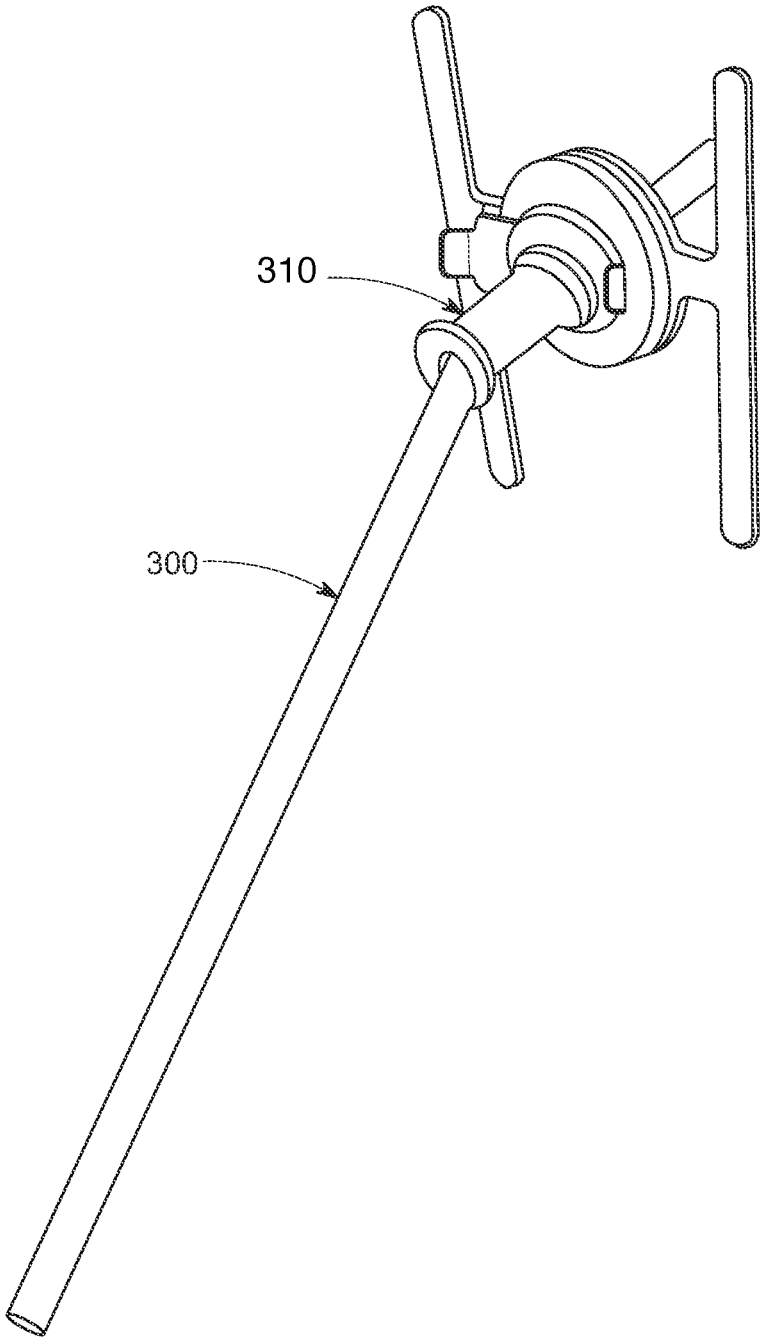
FIG. 5 is an illustration showing the straw in the safe sipper mask.

Safe sipper mask 100 may be used in conjunction with a specially designed straw 300 as illustrated in FIG. 4 and FIG. 5. Straw 300 may have a hollow tubular straw body that bends at any angle and length which may be paper, plastic or other type suitable material that is stiff enough to act as a self-supporting straw that includes a hollow passage or to aid liquid flow therethrough. Straw 300 may have a circular protrusion 310 extending outward from the body such that when straw 300 is placed through opening 212 only a portion of straw 300 passes through opening while circular protrusion 310 comes into contact with top component 205 thus stopping straw 300 from entering too far into the mouth of the user. Circular protrusion 310 also acts a straw stopping mechanism to stop any droplets from getting on the tip of straw 300. Once straw 300 comes out of safe sipper mask 100 the user may cover up a surface of straw 300 with circular protrusion 310 so aerosol droppings won't get on the exposed straw tip.

The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A face cover, the face cover having a front layer and back layer, the face cover configured to cover at least a mouth and a nose of a wearer, the face cover having an attachment with a tab and an opening wherein the opening is exposed when the tab is in a first position, wherein the attachment has a stabilizer positioned between the front layer and the back layer to provide stiffness in the face cover.

2. The face cover of claim 1, wherein the tab is in a slidable arrangement with a first component positioned in front of and on the front layer of the face cover.

3. The face cover of claim 2, wherein the first component has a slot for the tab to slide across.

4. The face cover of claim 3, wherein the tab has one or more protrusions at a first end or a second end to prevent the tab from sliding completely out of the slot on the first component.

5. The face cover of claim 2, wherein the opening is positioned on a second component, the second component positioned behind the back layer.

6. The face cover of claim 5, wherein the opening has a valve mechanism to prevent liquid from escaping out of the face cover when closed.

7. The face cover of claim 1, wherein the stabilizer has two longitudinal prongs extending from two lateral prongs.

8. The face cover of claim 7, wherein ends of the two longitudinal prongs are positioned in one or more pockets between the front layer and the back layer.

9. The face cover of claim 1, wherein the attachment is made of plastic.

10. A face cover, the face cover having a front layer and back layer, the face cover having an attachment with a tab and an opening, the tab having an aperture that is alignable with the opening wherein the opening is exposed when the tab is in a first position and closed when the tab is in a second position, wherein the tab has a first handle and a second handle at opposite ends.

11. The face cover of claim 10, wherein the face cover has one or more support members.

12. The face cover of claim 10, wherein the attachment has a slot for the tab to slide through.

* * * * *